US007201023B2

(12) United States Patent
Okuno et al.

(10) Patent No.: US 7,201,023 B2
(45) Date of Patent: Apr. 10, 2007

(54) YARN CARRIER OF WEFT KNITTING MACHINE

(75) Inventors: Masao Okuno, Wakayama (JP); Toshinori Nakamori, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/546,278

(22) PCT Filed: Feb. 25, 2004

(86) PCT No.: PCT/JP2004/002194

§ 371 (c)(1),
(2), (4) Date: Aug. 19, 2005

(87) PCT Pub. No.: WO2004/076732

PCT Pub. Date: Sep. 10, 2004

(65) Prior Publication Data

US 2006/0144096 A1 Jul. 6, 2006

(30) Foreign Application Priority Data

Feb. 26, 2003 (JP) ..... 2003-049795

(51) Int. Cl.
*D04B 15/52* (2006.01)

(52) U.S. Cl. ..... 66/126 R

(58) Field of Classification Search ..... 66/126 R, 66/127, 128, 131, 138, 139
See application file for complete search history.

(56) References Cited

U.S. PATENT DOCUMENTS 4,513,588 A 4/1985 Lutz
5,345,789 A * 9/1994 Yabuta ..... 66/126 A
6,021,651 A * 2/2000 Shima ..... 66/126 A
6,647,749 B2 * 11/2003 Ikoma ..... 66/126 A
6,981,393 B2 * 1/2006 Ikoma ..... 66/126 A
6,988,385 B2 * 1/2006 Miyamoto ..... 66/127

FOREIGN PATENT DOCUMENTS

| | | |
|---|---|---|
| DE | 44 07 708 | 9/1995 |
| JP | 55-120796 A | 8/1980 |
| JP | 55-148256 A | 11/1980 |
| JP | 59-144659 A | 8/1984 |
| JP | 61-58576 B2 | 12/1986 |
| JP | 62-45019 Y2 | 11/1987 |
| JP | 8-13295 A | 1/1996 |
| JP | 11-61606 A | 3/1999 |

* cited by examiner

*Primary Examiner*—Danny Worrell
(74) *Attorney, Agent, or Firm*—Harness, Dickey, Pierce P.L.C.

(57) ABSTRACT

When bringing pins (2) are engaged with the yarn carrier at the engagement portions (3*a*, 3*b*) near the center of the yarn carrier, the yarn carrier, as a normal carrier, feeds the yarn so that the yarn is applied to a knitting needle performing knitting operation by a carriage. When the bringing pins (2) are engaged with the yarn carrier at the engagement points (4*a*, 4*b*) near the rear side thereof in the travel direction, the yarn carrier, as an inlay carrier, feeds the yarn in preference to the knitting operation so that the yarn is not applied to the knitting needle performing the knitting operation by the carriage. When the projection portions (6*a*, 6*b*) of engagement releasing members (5*a*, 5*b*) are pressed by the contact thereof with the stopper, the engagement releasing members (5*a*, 5*b*) are moved backward, and slope portions (7*a*, 8*a*; 7*b*, 8*b*) push up the bringing pins (2) engaged with the yarn carrier at the engagement points (3*a*, 4*a*; 3*b*, 4*b*) so as to release the engagement.

8 Claims, 6 Drawing Sheets

(a)

(b)

YARN CARRIER OF WEFT KNITTING MACHINE

TECHNICAL FIELD

The present invention relates to a yarn carrier, in a weft knitting machine, that is brought by a carriage and thereby supplies yarn when producing a knitted fabric by travels of the carriage.

BACKGROUND ART

Conventionally, in a typical weft knitting machine, a knitted fabric is produced by letting a carriage travel back and forth along the longitudinal direction of a needle bed on which a large number of knitting needles are provided to be juxtaposed to each other. The carriage is provided with a knitting cam for letting the knitting needles perform a knitting operation. To the knitting needles performing a knitting operation, a knitting yarn is supplied from a yarn carrier that is brought by the carriage. In a weft knitting machine that is provided with at least the front and the rear needle beds, yarn guide rails are installed above a needle bed gap in which the front ends of the knitting needles proceeding from the front and the rear needle beds are opposed to each other, so as to face the needle bed gap, and yarn carriers suspended from the yarn guide rails travel along the yarn guide rails. Carriages are provided at the front and the rear needle beds and linked to each other by a bridge straddling the yarn guide rails. Pins for letting the carriages bring the yarn carriers can project and withdraw at the bridge and are engaged with the yarn carriers in the projecting state. An engagement position of the pin and the yarn carrier is normally set to be a position in which a knitting yarn is supplied from the yarn carrier at a timing at which the front ends of the knitting needles recede from the needle bed gap after proceeding thereinto when the knitting needles are led to perform a knitting operation by the knitting cam.

When a yarn carrier for supplying a knitting yarn at a normal timing and a yarn carrier for supplying a knitting yarn prior to the normal timing so as not to be hooked on knitting needles are used in combination, it is possible to perform inlay knitting (see Japanese Unexamined Patent Publication JP-A 55-148256, for example). According to JP-A 55-148256, a yarn feeding member corresponding to a yarn carrier for inlay knitting shown in FIGS. 5 to 9 has a shape different from that of a yarn feeding member for knitting a normal knitted fabric shown in FIG. 4. The shapes are different because the yarn feeding members supply knitting yarns at different timings by being engaged with pins at different positions with respect to a yarn feeding position. The positions of the front ends of the yarn feeding members for supplying knitting yarns at the needle bed gap are also different between the yarn feeding member for normal knitting and the yarn feeding member for inlay knitting.

In the yarn carrier brought by the carriage, by lifting the pin, engagement can be released and a travel thereof can be halted, so that it is possible to produce a knitted fabric, changing knitting yarns by changing yarn carriers in the middle of the course in which the knitted fabric is produced. When the carriage travels to the end portion of the knitting width and the yarn carrier abuts against a stopper that has been provided on the yarn guide rail, the pin is pushed up by, for example, a slope, and thus engagement with the pin can be mechanically released. In JP-A 55-148256, a configuration is shown in which with respect to the yarn feeding member for normal knitting shown in FIG. 4, the front end of the pin that has been engaged with an engagement point runs over a slope provided at a stopper and thus the engagement is released. With respect to the yarn feeding member for inlay knitting shown in FIGS. 5 to 9, a configuration is disclosed in which a switching component provided at the yarn feeding member can be displaced relatively back and forth, and when the front end of the switching component abuts against a stopper, the switching component recedes and a slope formed at the switching component pushes up the front end of the pin from the engagement point and thus the engagement is released.

The yarn feeding member for inlay knitting disclosed in JP-A 55-148256 is only for inlay knitting, and thus a timing at which a knitting yarn is supplied so as not to be hooked at a position where the knitting needles perform a knitting operation by the action of the knitting cam mounted on the carriage, and a position in which a knitting yarn is supplied at the needle bed gap are different from those of the yarn feeding member for normal knitting. This method by which the yarn feeding member for normal knitting and the yarn feeding member for inlay knitting are used in combination to produce a knitted fabric enables an inlay knitted fabric to be produced effectively when the knitting width is substantially constant. However, when the knitting width changes, it is impossible to produce a good inlay knitted fabric. More specifically, in the case where the knitting width changes, a better knitted fabric can be produced when the end portions are tucked and hooked on the knitting needles also in the course of inlay knitting. However, in the yarn feeding member only for inlay knitting, a timing at which a knitting yarn is supplied with respect to a knitting operation of knitting needles led by the knitting cam is different from that of the yarn feeding member for normal knitting, and thus it is impossible to supply a knitting yarn for a knitting operation of the knitting needles included in the knitting timing such as tucking.

DISCLOSURE OF INVENTION

It is an object of the invention to provide a yarn carrier, in a weft knitting machine, in which a plurality of engagement points are provided so that a knitting yarn can be supplied at a plurality of different timings and in which engagement with a pin can be released when the yarn carrier abuts against a stopper or the like.

The invention is directed to a yarn carrier, in a weft knitting machine, that yarn carrier is used for supplying a knitting yarn to knitting needles provided to be juxtaposed to each other in needle beds of the weft knitting machine, that can travel along a yarn guide rail parallel with a longitudinal direction of the needle beds, and that can be engaged with a pin projecting from a carriage and is brought by the carriage when engaged with the pin, wherein engagement with the pin is possible at a plurality of points that are spaced apart in a travel direction, and the yarn carrier comprises an engagement releasing member that has a projection portion and a plurality of slope portions, which projection portion is capable of projecting to a front side in a travel direction in which the yarn carrier is brought by the carriage, and is displaceable so that the engagement with the pin at any of the plurality of points can be released at the plurality of slope portions when the projection portion is pressed from the front side and recedes.

In addition, the invention is characterized in that the plurality of points engaged with the pin include:

an engagement point for a normal carrier in which a knitting yarn can be supplied so as to be hooked on knitting needles performing a knitting operation, and an engagement point for an inlay carrier in which a knitting yarn can be supplied so as not to be hooked on knitting needles performing a knitting operation.

In addition, the invention is characterized in that the engagement releasing members are provided so that the front sides thereof, with respect to back-and-forth travels of the carriage, are paired to be on one side and the other side of the yarn guide rail.

In addition, the invention is characterized in that the yarn carrier further comprises a spring that biases the projection portion of the engagement releasing member so as to project to the front side.

BRIEF DESCRIPTION OF DRAWINGS

Other and further objects, features, and advantages of the invention will be more explicit from the following detailed description taken with reference to the drawings wherein.

BEST MODE FOR CARRYING OUT THE INVENTION

Figure 1:
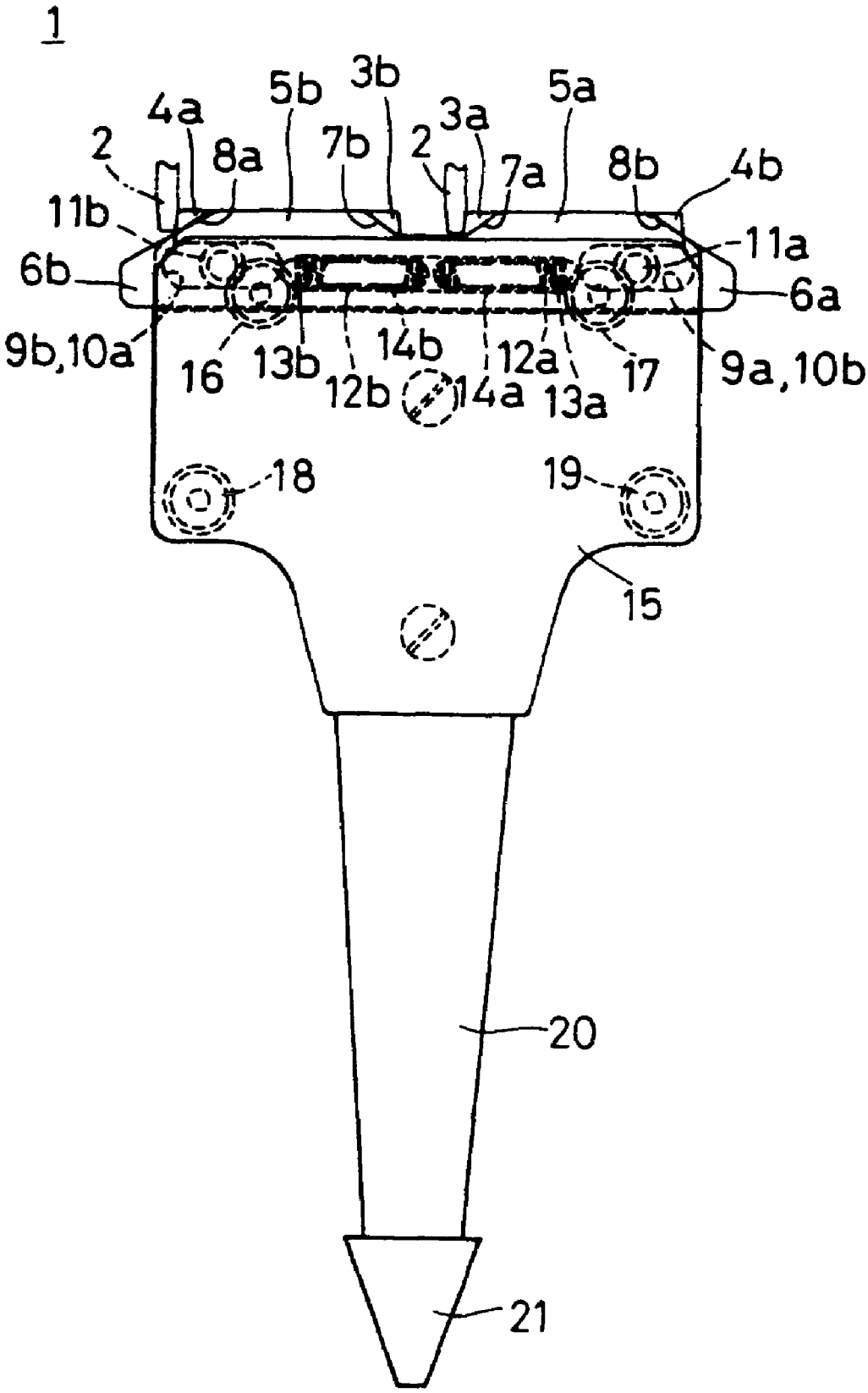
FIG. 1 is a front view showing a schematic configuration of a yarn carrier 1 according to an embodiment of the invention.

Now referring to the drawings, preferred embodiments of the invention are described below.

FIG. 1 shows a schematic configuration of a yarn carrier 1 according to an embodiment of the invention. The yarn carrier 1 of this embodiment can travel back and forth along the longitudinal direction of needle beds of a weft knitting machine, and has a plurality of engagement points 3*a*, 3*b*; 4*a*, 4*b* that can be engaged with a bringing pin 2 projecting and withdrawing at, for example, a bridge portion of a carriage (not shown). The yarn carrier 1 is brought by the carriage to travel back and forth to the left or the right in the drawing, and has the engagement points 3*a* and 4*a* used in a travel to the right and the engagement points 3*b* and 4*b* used in a travel to the left at symmetrical positions with respect to the center. When the bringing pin 2 is engaged with the engagement points 3*a* and 3*b*, which are close to the center, the yarn carrier 1 functions as a normal carrier and supplies a knitting yarn so as to be hooked on the knitting needles performing a knitting operation led by the carriage. When the bringing pin 2 is engaged with the engagement points 4*a* and 4*b*, which are close to the rear sides with respect to the travel directions, the yarn carrier 1 functions as an inlay carrier and supplies a knitting yarn prior to a knitting operation so as not to be hooked on the knitting needles performing a knitting operation led by the carriage. With the engagement points 3*a*, 3*b*; 4*a*, 4*b* that are engaged with the bringing pin 2, it is possible to switch between functions of a normal carrier and an inlay carrier, and thus it is possible to easily perform knitting in which both ends of an inlay knitted fabric are tucked on the knitting needles.

In order to release engagement of the bringing pin 2 that is engaged with each of the engagement points 3*a*, 3*b*; 4*a*, 4*b*, engagement releasing members 5*a* and 5*b* are provided. The engagement releasing members 5*a* and 5*b* are provided in such a manner that with respect to back-and-forth travels of the carriage, the engagement releasing member 5*a* that operates during a travel to the right in the drawing is paired with the engagement releasing member 5*b* that operates during a travel to the left. The engagement releasing member 5*a* has a projection portion 6*a* that projects to the right on the yarn carrier 1 in the drawing and slope portions 7*a* and 8*a* that release engagement of the bringing pin 2 at the engagement points 3*a* and 4*a*. The engagement releasing member 5*b* has a projection portion 6*b* that projects to the left on the yarn carrier 1 in the drawing and slope portions 7*b* and 8*b* that release engagement of the bringing pin 2 at the engagement points 3*b* and 4*b*.

These engagement releasing members 5*a* and 5*b* are formed by a metal plate or other materials, and are provided with pairs of elongated holes 9*a*, 10*a*; 9*b*, 10*b* that are spaced apart in the horizontal direction of the drawing. The elongated hole 9*a* of the engagement releasing member 5*a* and the elongated hole 10*b* of the engagement releasing member 5*b* are arranged at positions where one overlaps the other, and a supporting pin 11*a* is inserted into the holes. Furthermore, the elongated hole 9*b* of the engagement releasing member 5*b* and the elongated hole 10*a* of the engagement releasing member 5*a* are arranged at positions where one overlaps the other, and a supporting pin 11*b* is inserted into the holes. The engagement releasing members 5*a* and 5*b* can be displaced with relative to the yarn carrier 1 within a range in which the both ends of the elongated holes 9*a*, 10*a*; 9*b*, 10*b* do not abut against the supporting pins 11*a* and 11*b*. At positions between the pairs of the elongated holes 9*a*, 10*a*; 9*b*, 10*b* of the engagement releasing members 5*a* and 5*b*, elongated holes 12*a* and 12*b* are provided. At the elongated hole 12*a* of the engagement releasing member 5*a*, a spring receiving portion 13*a* is formed by partial bending on the right side in the drawing. At the elongated hole 12*b* of the engagement releasing member 5*b*, a spring receiving portion 13*b* is formed by partial bending on the left side in the drawing. The front ends of the spring receiving portions 13*a* and 13*b* are inserted into an elongated hole of a spacer (described later), and receive one ends of coil springs 14*a* and 14*b*.

A main unit 15 of the yarn carrier 1 that has the engagement points 3*a*, 3*b*; 4*a*, 4*b* for the bringing pin 2 and that is provided with the displaceable engagement releasing members 5*a* and 5*b*, is provided with rollers 16, 17, 18, and 19, and can be supported in such a manner that the main unit 15 can run on a yarn guide rail 22 (described later). An arm 20 is extended from the main unit 15, and the front end of the arm 20 is provided with a yarn feeding port 21 for supplying a knitting yarn to a needle bed gap.

Figure 2:
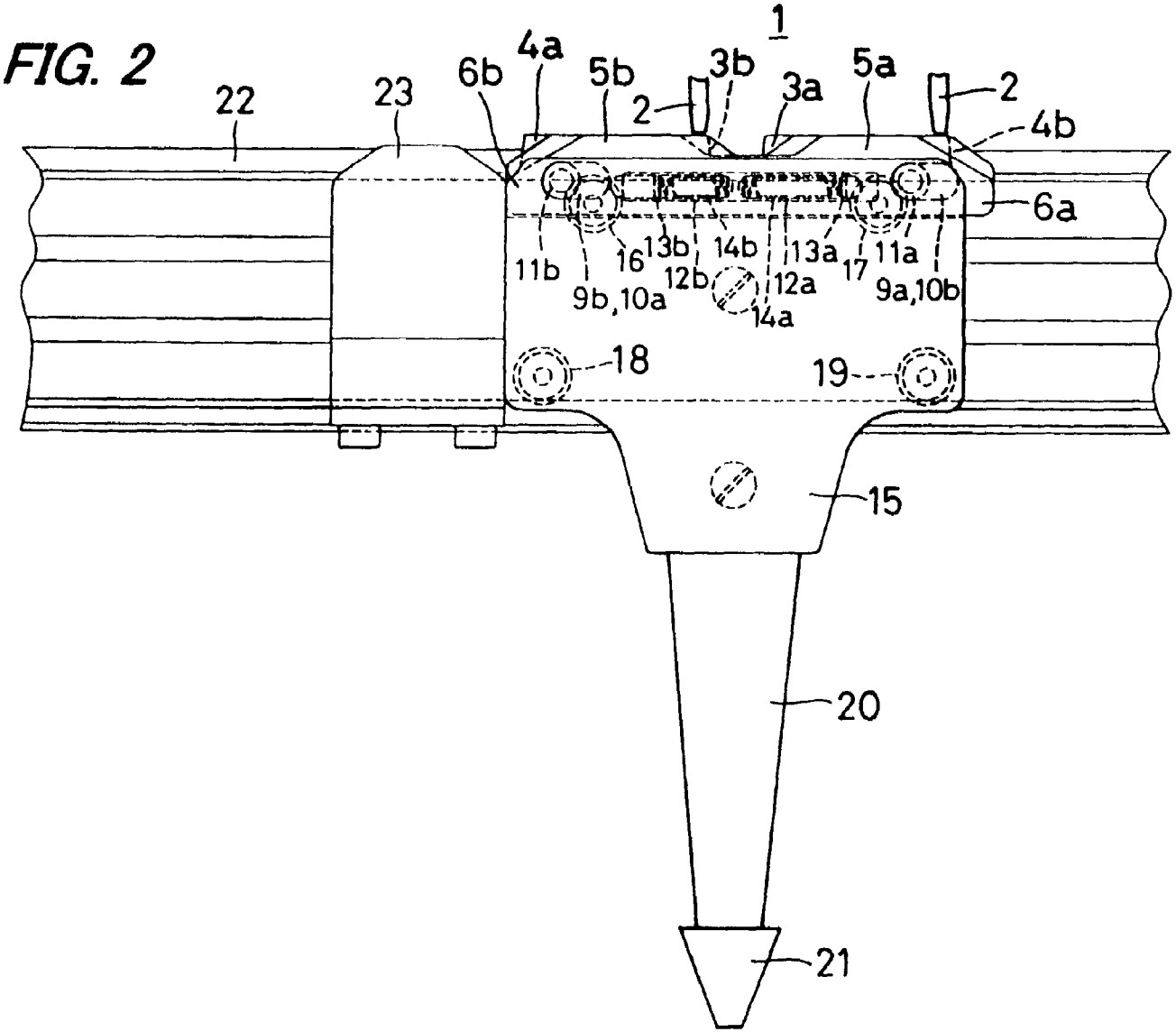
FIG. 2 is a front view showing a state in which the yarn carrier 1 in FIG. 1 travels along a yarn guide rail 22 and is halted abutting against a stopper 23.

FIG. 2 shows a state in which the yarn carrier 1 of this embodiment travels along the yarn guide rail 22 and is halted abutting against a stopper 23. For example, when the bringing pin 2 is engaged with any of the engagement points 3*b* and 4*b* and lets the yarn carrier 1 travel to the left in the drawing, the projection portion 6*b* of the engagement releasing member 5*b* abuts against the right side face of the stopper 23. When the bringing pin 2 is intended to further travel to the left, the projection portion 6*b* is pressed down and the engagement releasing member 5*b* is displaced to the right with relative to the main unit 15. With this relative displacement, the slope portion 7*b* or 8*b* pushes up the front end of the bringing pin 2 that is engaged with the engagement point 3*b* or 4*b* and releases the bringing pin 2 from the engagement point 3*b* or 4*b*. The bringing pin 2 is biased by a spring to project downwards, and thus when pushed up by the slope portion 7*b* or 8*b* with a force that is greater than the spring bias, the bringing pin 2 is pushed up from the engagement point 3*b* or 4*b* resisting the spring bias. The bringing pin 2 continues to travel to the left even after pushed up from the engagement point 3*b* or 4*b*, and thus the bringing pin 2 is parted from the engagement point 3*b* or 4*b* and thus the engagement is released. Also, in the case where the yarn carrier 1 abuts against the stopper 23 on the right side, the engagement releasing member 5*a* performs an operation to release the engagement of the bringing pin 2 in a similar manner.

Furthermore, a magnet is attached to the yarn carrier 1. Even after engagement of the bringing pin 2 at the engagement points 3*a*, 3*b*; 4*a*, 4*b* is released, a sliding friction on the yarn guide rail 22 deriving from the magnetic attraction of the magnet is set to be greater than the bias of the coil springs 14*a* and 14*b*, and thus the yarn carrier 1 holds the current position. Therefore, the bringing pin 2 that was engaged with the engagement points 4*a* and 4*b* for an inlay carrier and whose engagement is released reaches the engagement points 3*a* and 3*b* for a normal carrier when the carriage continues to travel. However, since the engagement points 3*a* and 3*b* are closed with the slope portions 7*a* and 7*b* of the engagement releasing members 5*a* and 5*b*, the bringing pin 2 is not engaged with the engagement point 3*a* or 3*b*.

It should be noted that a plurality of yarn carriers 1 can be arranged in the longitudinal direction of one yarn guide rail 22. One of the plurality of yarn carriers 1 is selected by letting the bringing pin 2 project and be engaged with the engagement point 3*a*, 3*b*, 4*a*, or 4*b*. As for the knitting cam provided at the carriage, a plurality of sets can be provided so that a plurality of knitting operations can be performed in one travel. Each of the plurality of knitting cams brings the yarn carrier 1 to let a knitting yarn be supplied. Therefore, the stopper 23 provided on the yarn guide rail 22 is to halt travels of the plurality of yarn carriers 1. As for the yarn carrier 1 of this embodiment, when between the stopper 23 and the yarn carrier 1 engaged with the bringing pin 2, there is another yarn carrier 1, the yarn carrier 1 on the frontmost abuts against the stopper 23 and is halted first. Subsequently, the yarn carrier 1 abuts against its preceding yarn carrier 1 and is halted sequentially, and engagement with the bringing pin 2 can be released by, instead of abutting against the stopper 23, abutting against the preceding yarn carrier 1, and the travel thereof can be thus halted.

Figure 3:
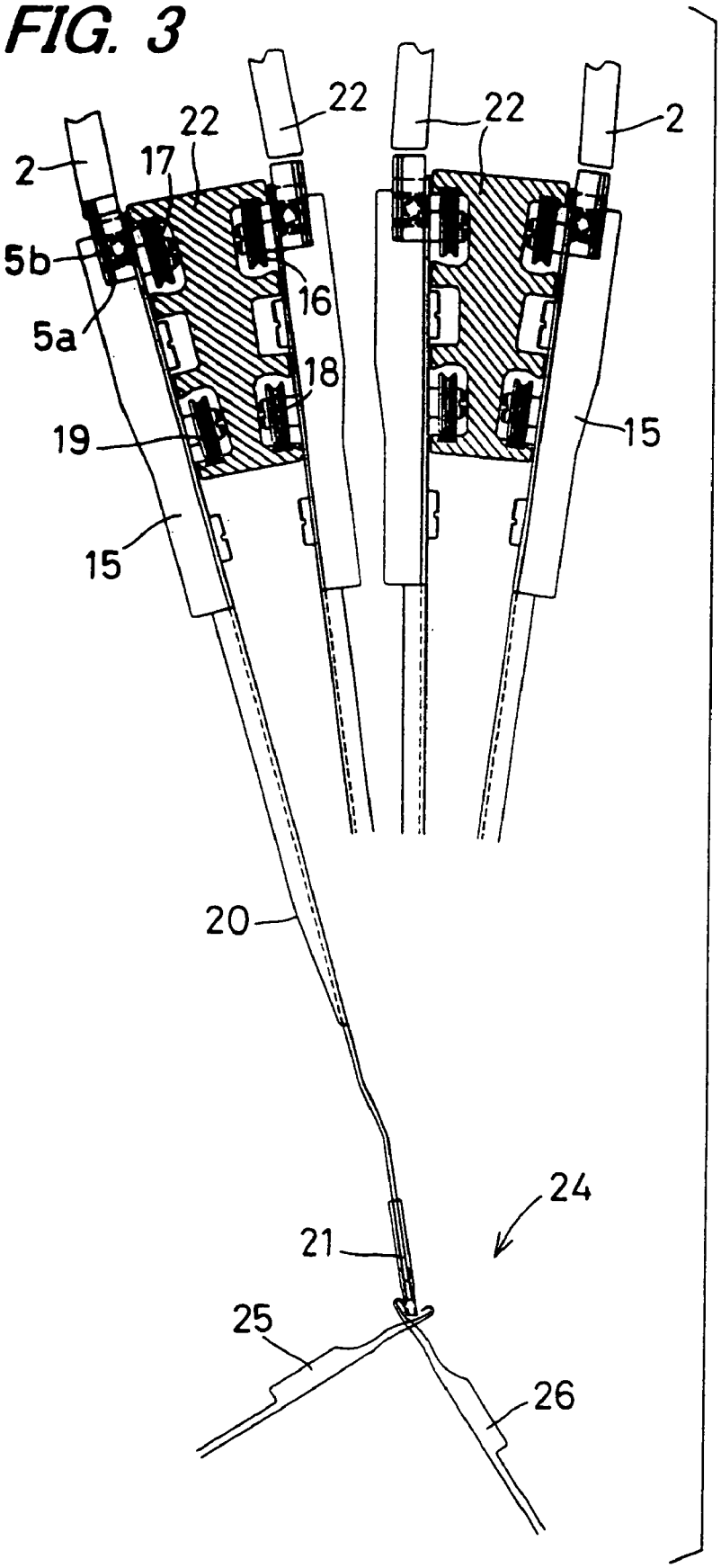
FIG. 3 is a right side cross-sectional view showing a configuration in which the yarn carriers 1 in FIG. 1 are attached to the plurality of yarn guide rails 22 and displaceably supported by rollers 16, 17, 18, and 19.

FIG. 3 shows a cross-sectional configuration in which the plurality of yarn carriers 1 are attached to the plurality of yarn guide rails 22 and displaceably supported by the rollers 16, 17, 18, and 19. Although the arm 20 and the yarn feeding port 21 are shown only for one yarn carrier 1, also in other yarn carriers 1, the yarn feeding port 21 provided at the front end of the arm 20 faces the needle bed gap 24 and supplies a knitting yarn in a basically similar manner. A position for supplying a knitting yarn is a position in which knitting needles 25 and 26 proceed from the front and the rear needle beds and can catch a knitting yarn with the hooks thereof. When the bringing pin 2 is engaged with the engagement points 3*a* and 3*b* for a normal carrier, a knitting yarn is supplied from the yarn feeding port 21 at a timing at which the knitting needles 25 and 26 recede from the needle bed gap after proceeding thereinto, and thus it is possible to perform knitting by hooking the knitting yarn on the knitting needles 25 and 26. When the bringing pin 2 is engaged with the engagement points 4*a* and 4*b* for an inlay carrier, a knitting yarn is supplied from the yarn feeding port 21 prior to a timing at which the knitting needles 25 and 26 proceed into the needle bed gap 24, and thus the knitting yarn goes under the knitting needles 25 and 26, so that it is possible not to hook the knitting yarn on the knitting needles 25 and 26.

Figure 4:
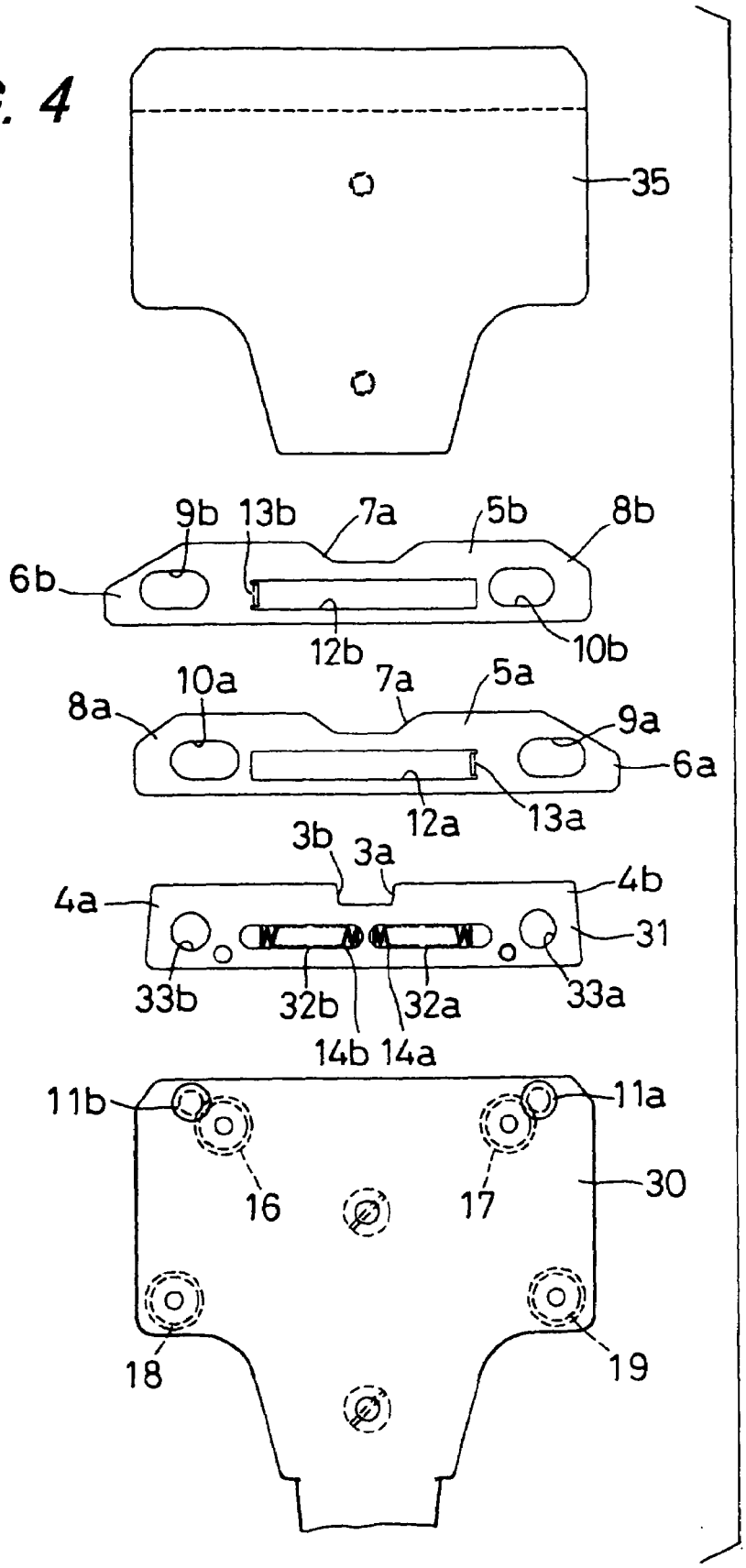
FIG. 4 is a front view showing components that constitute a main unit 15 of the yarn carrier 1 in FIG. 1.

FIG. 4 shows components that constitute the main unit 15 of the yarn carrier 1 in this embodiment. A base 30 is formed by a metal plate or other materials, is formed in one piece with the arm 20, and is disposed on the rear face side in the drawing. To the surface of the base 30, a spacer 31 is attached that is formed, for example, a synthetic resin. On the spacer 31, the elongated holes 32*a* and 32*b* for accommodating the coil springs 14*a* and 14*b* are formed on positions that are close to the center. On the both sides of the elongated holes 32*a* and 32*b*, supporting holes 33*a* and 33*b* for letting the supporting pins 11*a* and 11*b* shown in FIG. 1 through are provided.

On the front face side of the spacer 31, the engagement releasing members 5*a* and 5*b* are arranged one on top of the other. For example, the engagement releasing member 5*a* is on the rear face side, and the spring receiving portion 13*a* is inserted into the elongated hole 32*a* of the spacer 31 and receives one end of the coil spring 14*a*. The other end of the coil spring 14*a* abuts against the end portion of the elongated hole 32*a* at a position that is close to the center. In this manner, the coil spring 14*a* biases the engagement releasing member 5*a* to the right in the drawing. On the front face side of the engagement releasing member 5*a*, the engagement releasing member 5*b* is disposed. The spring receiving portion 13*b* of the engagement releasing member 5*b* goes into the elongated hole 12*a* of the engagement releasing member 5*a* to be inserted into the elongated hole 32*b* of the spacer 31 and receives one end of the coil spring 14*b*. The other end of the coil spring 14*b* abuts against the end portion of the elongated hole 32*b* at a position that is close to the center. In this manner, the coil spring 14*b* biases the engagement releasing member 5*b* to the left in the drawing. The surface of the main unit 15 is covered by a cover 35.

Figure 5:
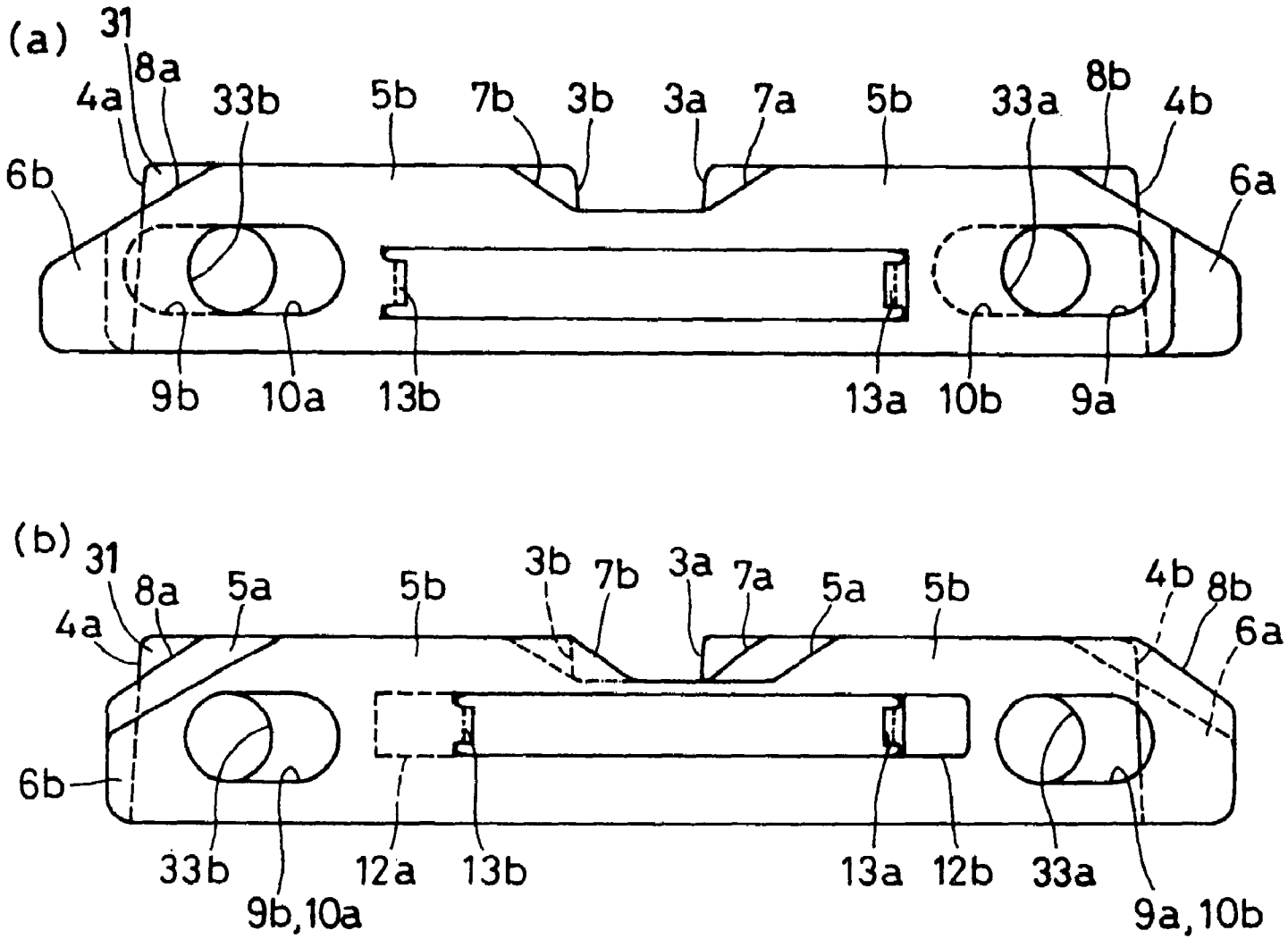
FIG. 5 is a view showing the relative positional relationship among engagement releasing members 5*a* and 5*b* and a spacer 31 in the yarn carrier 1 in FIG. 1.

FIG. 5 shows the relative positional relationship among the engagement releasing members 5*a* and 5*b* and the spacer 31. Herein, drawing of the elongated holes 32*a* and 32*b* of the spacer 31 has been omitted. FIG. 5(*a*) shows a state in which the bringing pin 2 is engaged with the engagement point 3*a*, 4*a*, 3*b*, or 4*b* and can move in connection therewith as shown in FIG. 1, and FIG. 5(*b*) shows a state in which engagement is released by abutting against, for example, the stopper 23 as shown in FIG. 2. In the state where engagement is possible as shown in FIG. 5(*a*), the projection portions 6*a* and 6*b* of the engagement releasing members 5*a* and 5*b* project and the slope portions 7*a*, 8*a*; 7*b*, 8*b* are apart from the engagement points 3*a*, 4*a*; 3*b*, 4*b*, and thus engagement with the bringing pin 2 is possible. In the state where, for example, in a travel to the left, the projection portion 6*b* of the engagement releasing member 5*b*, which is one of the engagement releasing members, abuts against the stopper 23 or the side face of another yarn carrier 1, the engagement releasing member 5*b* moves relatively to the right, and thus the slope portions 7*b* and 8*b* cover the engagement points 3*b* and 4*b* as shown in FIG. 5(*b*). When any of the engagement points 3*b* and 4*b* is engaged with the bringing pin 2, the front end of the bringing pin 2 is pushed up by the slope portion 7*b* or 8*b*, and thus the engagement is released.

During this travel to the left, since the other engagement releasing member 5*a* is not displaced, when the amount at which the tail portion of the engagement releasing member 5*a* projects is set, even in the most receding state, not to project to the right exceeding the front end of the projection portion 6*a* of the other engagement releasing member 5*a*, the apparent amount at which the pair of engagement releasing members 5*a* and 5*b* projects to the right can be set not to change overall. Although it is possible to form the pair of engagement releasing members 5*a* and 5*b* in one piece, in the case where the pair is formed in one piece, when the projection portion 6*b* abuts against, for example, the stopper 23 and recedes, the other projection portion 6*a* projects further, and thus it is necessary to provide a mechanism that can return the engagement releasing member to the center position reliably. In this embodiment, the pair of engagement releasing members 5*a* and 5*b* are separately formed, and thus an operation to release engagement can be performed reliably and simply.

Also, the yarn carrier 1 of this embodiment further includes the coil springs 14*a* and 14*b* that bias the projection portions 6*a* and 6*b* of the engagement releasing members 5*a* and 5*b* to project forwards, but it is also possible that the spring bias of, for example, the coil springs 14*a* and 14*b* is not applied. In the case where the engagement releasing members 5*a* and 5*b* can travel smoothly, the engagement releasing members 5*a* and 5*b* can be displaced by the bringing pin 2, as long as the projection portion 6*a* or 6*b* does not abut against, for example, the stopper 23 or another yarn carrier 1. Even when the slope portion 7*a*, 8*a*, 7*b*, or 8*b* covers the engagement point 3*a*, 4*a*, 3*b*, or 4*b*, the front end of the bringing pin 2 presses the slope portion 7*a*, 8*a*, 7*b*, or 8*b* to let the engagement releasing member 5*a* or 5*b* move to the side of the projection portion 6*a* or 6*b*, so that the slope portion 7*a*, 8*a*, 7*b*, or 8*b* does not cover the engagement point 3*a*, 4*a*, 3*b*, or 4*b*.

In this embodiment, however, the coil springs 14*a* and 14*b* bias the projection portions 6*a* and 6*b* of the engagement releasing members 5*a* and 5*b* to project forwards. With this configuration, as long as the projection portion 6*a* or 6*b* does not abut against, for example, the stopper 23, it is possible to let the projection portions 6*a* and 6*b* always project so that the slope portion 7*a*, 8*a*, 7*b*, or 8*b* does not cover the engagement point 3*a*, 4*a*, 3*b*, or 4*b*, and thus engagement with the bringing pin 2 can be reliably performed.

Figure 6:
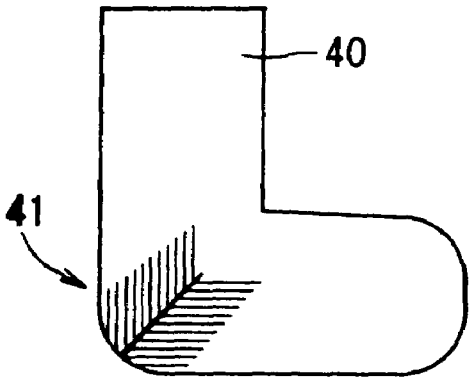
FIG. 6 is a view showing a sock 40 as an example of a knitted fabric that can be preferably produced using the yarn carrier 1 in FIG. 1.
Figure 6:
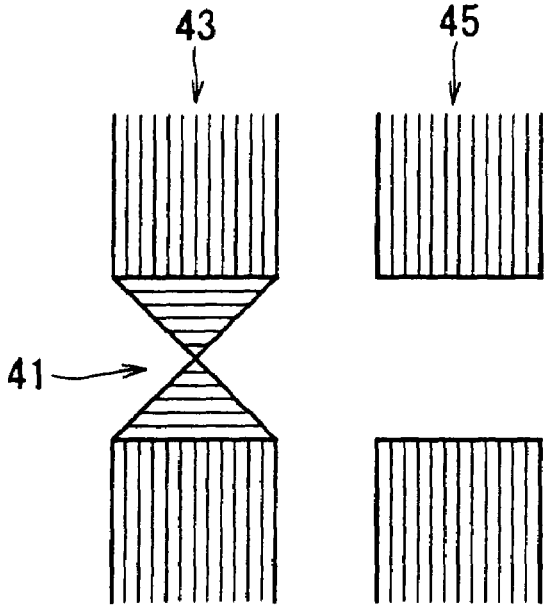

FIG. 6 shows an example of a knitted fabric that can be preferably produced using the yarn carrier 1 of this embodiment. FIG. 6(*a*) shows a sock 40 as a completed knitted fabric. The sock 40 has a heel portion 41, and is to be produced in three dimensions. FIG. 6(*b*) shows a knitted fabric in which the sock 40 in FIG. 6(*a*) is cylindrically knitted separately between the front and the rear needle beds of the weft knitting machine. For example, a rear needle bed knitted fabric 43, which is to be produced at the rear needle bed, includes a knitting width changing portion to form the heel portion 41. A front needle bed knitted fabric 45, which is to be produced at the front needle bed, is produced with the substantially constant knitting width. When inlay knitting is performed in the heel portion 41, it is preferable that a knitting yarn is not only simply led through the knitted fabric, but also tucked on the knitting needles at the both sides of the knitting width. The heel portion 41 is knitted by short rows.

With use of the yarn carrier 1 of this embodiment, the bringing pin 2 can be engaged with the engagement points 3*a* and 3*b* to perform tucking at the start of knitting, and then the bringing pin 2 can be engaged with the engagement points 4*a* and 4*b* to perform inlay knitting. Switching between the engagement points 3*a*, 4*a*; 3*b*, 4*b* at the start of knitting is performed by letting the carriage that has once moved recede and then move again.

It should be noted that the position of the yarn feeding port 21 with respect to the needle bed gap 24 can be changed by applying the configuration for letting the position of a yarn feeding portion of a yarn carrier approach to the front end portion of knitting needles, which has been disclosed by the applicant of the invention in Japanese Unexamined Patent Publication JP-A 11-61606.

As described above, the yarn carrier 1 in a weft knitting machine in this embodiment is used for supplying a knitting yarn to the knitting needles 25 and 26 that are provided side by side on the needle beds of the weft knitting machine, can travel along the yarn guide rail 22 parallel with the longitudinal direction of the needle beds, and can be engaged with the bringing pin 2 projecting from the carriage. The yarn carrier 1 is brought by the carriage and travels when engaged with the bringing pin 2. The engagement with the bringing pin 2 is possible at the plurality of engagement points 3*a*, 4*a*; 3*b*, 4*b* that are provided to be spaced apart in the travel direction, and thus it is possible to let timings for supplying a knitting yarn be different, depending on the engagement points 3*a*, 4*a*; 3*b*, 4*b*. This change of timings for supplying a yarn is useful not only when using functions of a normal carrier and an inlay carrier properly, but also when producing various knitted fabrics and when letting the end of a yarn be drawn into the knitted fabric. The yarn carrier 1 includes the engagement releasing members 5*a* and 5*b*, and the engagement releasing members 5*a* and 5*b* have the projection portions 6*a* and 6*b* and the plurality of slope portions 7*a*, 8*a*; 7*b*, 8*b*. The projection portions 6*a* and 6*b* of the engagement releasing members 5*a* and 5*b* can project to the front sides in the travel directions in which the yarn carrier 1 is brought by the carriage, and can be displaced so that the engagement with the bringing pin 2 can be released at any of the plurality of slope portions 7*a*, 8*a*; 7*b*, 8*b* when the projection portions 6*a* and 6*b* are pressed from the front sides and recede. When, for example, the stopper 23 is provided in the middle of the yarn guide rail 22, the projection portions 6*a* and 6*b* of the engagement releasing members 5*a* and 5*b* abut against the stopper 23 or so forth, and thus engagement with the bringing pin 2 can be released at the slope portions 7*a*, 8*a*; 7*b*, 8*b*.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, a yarn carrier in a weft knitting machine is used for supplying a knitting yarn to knitting needles provided to be juxtaposed to each other in needle beds of the weft knitting machine, can travel along a yarn guide rail parallel with the longitudinal direction of the needle beds, and can be engaged with a pin projecting from a carriage, and is brought by the carriage and travels when engaged with the pin. Engagement with the pin is possible at a plurality of points that are spaced apart in the travel direction, and thus it is possible to let timings for supplying a knitting yarn be different, depending on the engagement points. The yarn carrier includes an engagement releasing member, and the engagement releasing member has a projection portion and a plurality of slope portions. The projection portion of the engagement releasing member can project to the front side in the travel direction in which the yarn carrier is brought by the carriage, and the releasing member is displaceable so that the engagement with the pin can be released at any of the plurality of slope portions when the projection portion is pressed from the front side and recedes. When, for example, a stopper is provided in the middle of the yarn guide rail, the projection portion of the engagement releasing member abuts against the stopper or so forth, and thus engagement with the pin can be released at the slope portion.

Furthermore, according to the invention, the plurality of points engaged with the pin include an engagement point for a normal carrier in which a knitting yarn can be supplied so as to be hooked on knitting needles performing a knitting operation, and an engagement point for an inlay carrier in which a knitting yarn can be supplied so as not to be hooked on knitting needles performing a knitting operation. Thus, the yarn carrier can be used for not only inlay knitting but also normal knitting.

Furthermore, according to the invention, the engagement releasing members are provided so that the front sides thereof, with respect to back-and-forth travels of the carriage, are paired to be on one side and the other side of the yarn guide rail. Thus, only one side of the engagement releasing member that corresponds to the travel direction of the carriage abuts against, for example, the stopper, to be displaced, and thus the engagement with the pin can be released. The engagement releasing members that project to one sides are provided to be paired with each other. Thus, it is not necessary to let the opposite side of the projection portion project as much as the other projection portion, and when the projection portion abuts against, for example, the stopper and recedes, it is possible to suppress the projection of the opposite side within a range in which the other projection portion projects.

Furthermore, according to the invention, a spring biases the projection portion of the engagement releasing member so as to project to the front side. Thus, it is possible to let the projection portion project, as long as the projection portion does not abut against, for example, the stopper, so that engagement with the pin is not released at the slope portion and the bringing pin can be reliably engaged.

The invention claimed is:

1. A yarn carrier, in a weft knitting machine, for supplying a knitting yarn to knitting needles provided to be juxtaposed to each other in needle beds of the weft knitting machine, the yarn carrier travels back and forth along a yarn guide rail parallel with a longitudinal direction of the needle beds, and engaged with a pin projecting from a carriage, and is brought by the carriage when engaged with the pin, comprising:

a plurality of engagement points for engaging with the pin provided spaced apart from each other along back-and-forth travel directions, some of the plurality of engagement points are provided for engagement in bringing the yarn carrier by the carriage in one of the back-and-forth travel directions, and other plurality of engagement points are provided for engagement in bringing the yarn carrier by the carriage in another back-and-forth travel directions, the pin can be selectively engaged with one of the plurality of engagement points, and the yarn carrier includes engagement releasing members provided in one and the other of the back-and-forth travel directions, respectively, which engagement releasing members each have a projection portion and a plurality of slope portions provided in accordance with the plurality of engagement points, which projection portion are capable of projecting to a front side in a travel direction in which the yarn carrier is brought by the carriage, the releasing member being displaceable so that the engagement with the pin at the plurality of engagement points can be released at the plurality of slope portions when the projection portion is pressed from the front side and recedes.

2. The yarn carrier of claim 1, wherein the plurality of engagement points engaged with the pin further comprising:

an engagement point for a normal carrier in which a knitting yarn can be supplied so as to be hooked on knitting needles performing a knitting operation, and an engagement point for an inlay carrier in which a knitting yarn can be supplied so as not to be hooked on knitting needles performing a knitting operation.

3. The yarn carrier of claim 1, wherein the engagement releasing members are provided so that the front sides thereof, with respect to back-and-forth travels of the carriage, are paired to be on one side and the other side of the yarn guide rail.

4. The yarn carrier of claim 1, further comprising a spring that biases the projection portion of the engagement releasing member so as to project to the front side.

5. The yarn carrier of claim 2, wherein the engagement releasing members are provided so that the front sides thereof, with respect to back-and-forth travels of the carriage, are paired to be on one side and the other side of the yarn guide rail.

6. The yarn carrier of claim 2, further comprising a spring that biases the projection portion of the engagement releasing member so as to project to the front side.

7. The yarn carrier of claim 3, further comprising a spring that biases the projection portion of the engagement releasing member so as to project to the front side.

8. The yarn carrier of claim 5, further comprising a spring that biases the projection portion of the engagement releasing member so as to project to the front side.

* * * * *